US006601912B1

(12) United States Patent
Chen

(10) Patent No.: US 6,601,912 B1
(45) Date of Patent: Aug. 5, 2003

(54) FOLDING CHAIR WITH HARD ARMS

(75) Inventor: Libin Chen, Jiangsu (CN)

(73) Assignee: Changzhou Qiaoyu Travel Articles Co., Jiangsu (CN)

( * ) Notice: Subject to any disclaimer, the term of this patent is extended or adjusted under 35 U.S.C. 154(b) by 0 days.

(21) Appl. No.: 10/135,713

(22) Filed: Apr. 29, 2002

(30) Foreign Application Priority Data

Mar. 22, 2002 (CN) ..... 022194710 U
Mar. 22, 2002 (CN) ..... 022194720 U

(51) Int. Cl.[7] ..... A47C 4/28
(52) U.S. Cl. ..... 297/45; 297/38
(58) Field of Search ..... 297/411.3, 411.32, 297/16.1, 16.2, 42, 45, 35, 38, 41

(56) References Cited

U.S. PATENT DOCUMENTS 5,584,529 A * 12/1996 Cheng
6,149,238 A * 11/2000 Tsai
6,454,348 B1 * 9/2002 Wu

FOREIGN PATENT DOCUMENTS

| | | |
|---|---|---|
| CN | 96232424.8 | 7/1996 |
| CN | 99123256.9 | 10/1999 |
| CN | 00261993.8 | 12/2000 |

* cited by examiner

*Primary Examiner*—Milton Nelson, Jr.
(74) *Attorney, Agent, or Firm*—Yi Li

(57) ABSTRACT

A folding chair with hard arms has front and rear support tubes, left and right support tubes, chair back auxiliary tubes. The left and right support tubes are bent upward to form the arm support tubes. One end of a hard arm is pivotally connected to the upper end of the arm support tube and another end has an arm fixing shackle. A sliding element is pivotally connected at one end to the auxiliary tube and its another end is slide-connected with the hard arm. The hard arm folding chair uses a sliding structure for the arms, and it utilizes the arm fixing shackle device to enable the arms to be withdrawn with the chair. The hard arm folding chair provides support to the user for standing up and reduces deformation of the flexible seat and back material, therefore improving comfort.

13 Claims, 7 Drawing Sheets

FOLDING CHAIR WITH HARD ARMS

FIELD OF THE INVENTION

The present invention relates to a folding chair, especially a folding chair with hard arms suitable for use in sites such as field travel, courtyard and garden, etc.

BACKGROUND OF THE INVENTION

With increasing demand of people for field life condition and increasing outdoor leisure activities, a portable type folding chair becomes very practical. The folding chair generally uses a structural member as the skeleton, takes a fabric such as oxford cloth woven with nylon filament as chair back and seat. The folding chair can conveniently folded for packaging, but and it can be unfolded smoothly and firm in structure. At present, with the increase of people living level, they not only chase after the folding and unfolding effects of such a chair, but also pay attention to the comfort effect on use.

China Patent ZL96232424.8 discloses a technical scheme entitled " folding type conjoined travel chair". In the prior art, four seat connectors and four leg connectors are provided, and upright and inclined tubes are used for connection between them. The chair back and seat use the oxford cloth, and PVC coat is applied on the oxford cloth. This kind of folding chair is good in folding and opening-out effects, but is poor in comfort effect on use.

China patent application disclosure specification CN 1252968A discloses a technical scheme entitled "folding type chair for carrying about". In the prior art, the chair has a support structure similar to that of the former prior art, has four leg connectors in contact with the ground and eight inclined tube members and two vertical tube members for connection via hinge joints respectively. Two front fixing connectors and two rear sliding connectors joined to these tube members are further set up. The folding chair in the prior art has a pair of arms, the arm is composed of a cup-laid part and an arm belt fixed on the support body, the arm belt possesses elasticity and has one end fixed on the cup-laid part, and another end is provided with a hole and hung on the member via the hole. The prior art adds the arms and so raises the comfortableness on use. However, since the arms itself are soft, it cannot bear weight, when a seated person wishes to stand up, he cannot get aid from the arms and only can rely on grasping the front support.

China patent ZL00261993.8 discloses a technical scheme entitled "multi-purpose leisure folding chair". The prior art has the chair back adjustable, with a pair of arms set up at two side ends of the chair The arm uses an elastic cloth belt with its two ends fixed on the support respectively. The prior art still has not solved the problem of softness of the arms itself, in particular, after the chair back has been adjusted downward, a seated person will be more difficult to stand up from the chair.

For those persons of heavy weight or elderly, the above-mentioned problem is more apparent.

Based on the above description, existing folding chairs with soft arms failed to provide support to the user when the person stands up from the chair. The person can only grasp the front support of the chair, which is very inconvenient. In an effort of overcoming these defects, hard arms have been utilized. However, in the prior art design, the hard arms are fixed. When the chair is folded, the arms have to be dismounted, which is very inconvenient to use.

In addition, with the soft arm chairs because the arms are soft, it cannot bear weight. After the chair is used for a period of time, due to the structures, the phenomena of bearing tube deformation and seat material loosening emerge, which affects the comfort in use.

SUMMARY OF THE INVENTION

The object of the present invention is to provide a folding chair with hard arms to overcome the above-mentioned defect. The chair is provided with a pair of hard arms by setting up a sliding device. The hard arm chair can be withdrawn along with the chair and is fixed by a shackle device after the chair is unfolded to achieve convenience in use.

Another object of the invention is to provide a folding chair with hard arms and increase the supporting effect of folding chair itself by installing a pair of hard arms so to tighten the flexible material support such that the flexible material will not deform and the to improve comfort.

Therefore the present invention puts forward such a folding chair with hard arms that it has front and rear support tubes, left and right support tubes, the bottom end of the support tubes are linked with leg bases, middle parts are mutually hinged two by two, and the upper ends are connected with the seat base. Four corners of base plane are connected with the seat base respectively. The rear part of the folding chair has chair back tubes, the bottom ends of the chair back tubes are connected with leg bases, the middle parts are connected with the seat base and the upper ends are connected with the flexible material of chair back. There are chair back auxiliary tubes at the two sides of the chair back part of the folding chair with hard arms. The forward-inclined support tubes of the left and right support tubes are bent upward to form the arm support tubes. One end of a hard arm is connected pivotally, such as pin-jointed, with the upper end of arm support tube and the other end has the arm fixing shackle; There is a sliding element on each side of the folding chair, with one end connected pivotally, such as pin-jointed, with the auxiliary tube and with the other end slide-connected with the hard arm.

The hard arm and the sliding element can be matched concave slot and convex block slide-connection.

The bottom of the hard arm has the sliding concave groove.

The sliding element has a sliding body. On the upper part of the sliding body there is a sliding convex block, and on the lower part of the sliding body there is a lug. The lug has a connection hole.

The sliding convex block of the sliding element is matched with the sliding concave groove at the bottom of the hard arm.

The lug at lower part of the sliding element is pin-jointed through its connection hole with the middle part of the auxiliary tube by means of a pin shaft.

The top part of the arm fixing shackle has a connection hole. The top part extends downward into two side arms. A bayonet is set between the two side arms, and the bayonet locks on the auxiliary tube. Each chair back tube has a locating pin close to the upper end. The side arm of the fixing shackle has a shackle slot for clamp-fixing onto the locating pin.

One side arm of the arm fixing shackle can be extended to form a positional element.

The lower part of the chair back tube also has a locating pin.

The hard arm and sliding element can be slide-connected with matched sliding-sleeve and sliding-rod.

A sliding-rod is set up at the bottom of the hard arm, with one end connected with the front end of the hard arm and the other end connected with the rear end of the hard arm.

The sliding element has a sliding body. The upper part of the sliding body has a sliding-sleeve and the lower part has a lug. The lug possesses a connection hole.

The hard arm can have a groove for inserting arm covering cloth, and the arm covering cloth can be held in the groove.

The sliding-sleeve of the sliding element is matched with the sliding-rod at the bottom of the hard arm.

The connection hole of the lug at the lower part of the sliding element is pivotally connected, for example pin-jointed, with the middle part of the auxiliary tube by means of a pin shaft.

As compared with the prior art, the features and merits of the present invention are: the arm of the folding chair with hard arms of the present invention employs the sliding structure and effectively overcomes the defect in the prior art. It not only provides the hard arms which supports the seated person with the aid of the arms in standing up from the chair, but also enables the hard arms to withdraw along with the chair by using the arm fixing shackle device. At the same time, the hard arms improve the support of the folding chair, which in turn tightens the flexible material. Therefore, the folding chair has no deformation, which improve comfort in use. Furthermore, the folding chair of the present invention is convenient for both storage and carrying.

DETAILED DESCRIPTION OF THE INVENTION

For the purpose of more clearly understanding the above-mentioned objectives and the technology, means and effect of the present invention, now an embodiment for the folding chair with hard arms of the invention is explained along with the reference to the drawings.

Figure 1:
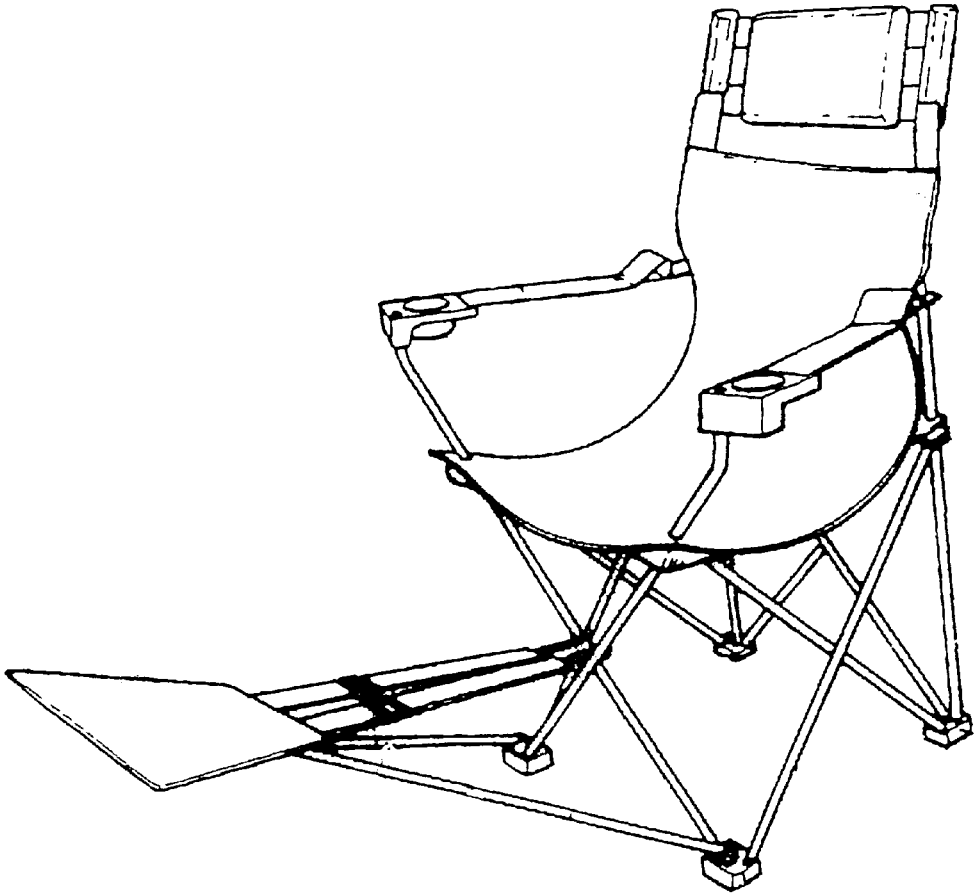
FIG. 1 is a schematic diagram of folding chair in the prior art.
Figure 2:
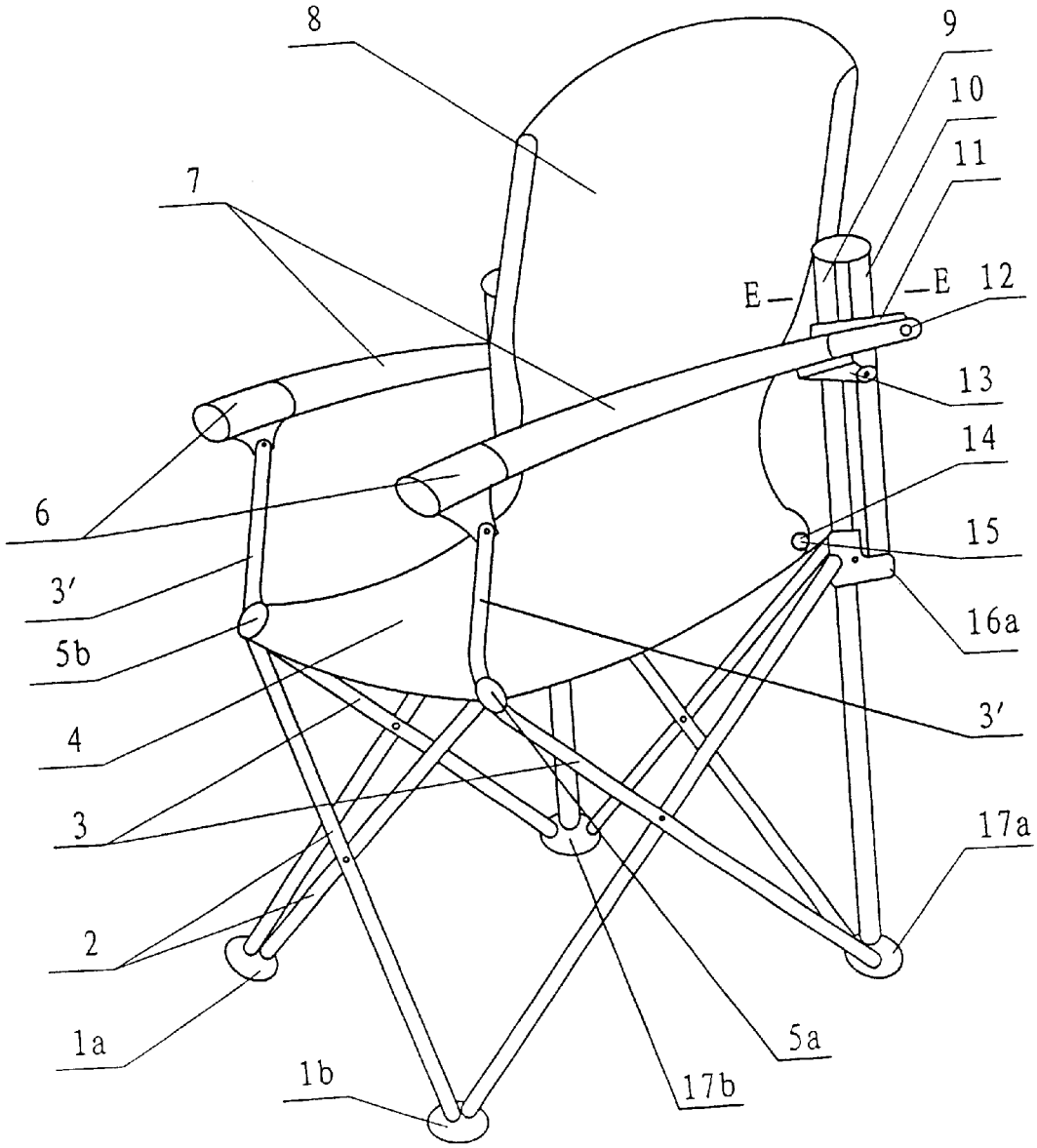
FIG. 2 is a schematic diagram of folding chair with hard arms of the invention, the folding chair in the diagram is in the usage state.
Figure 3:
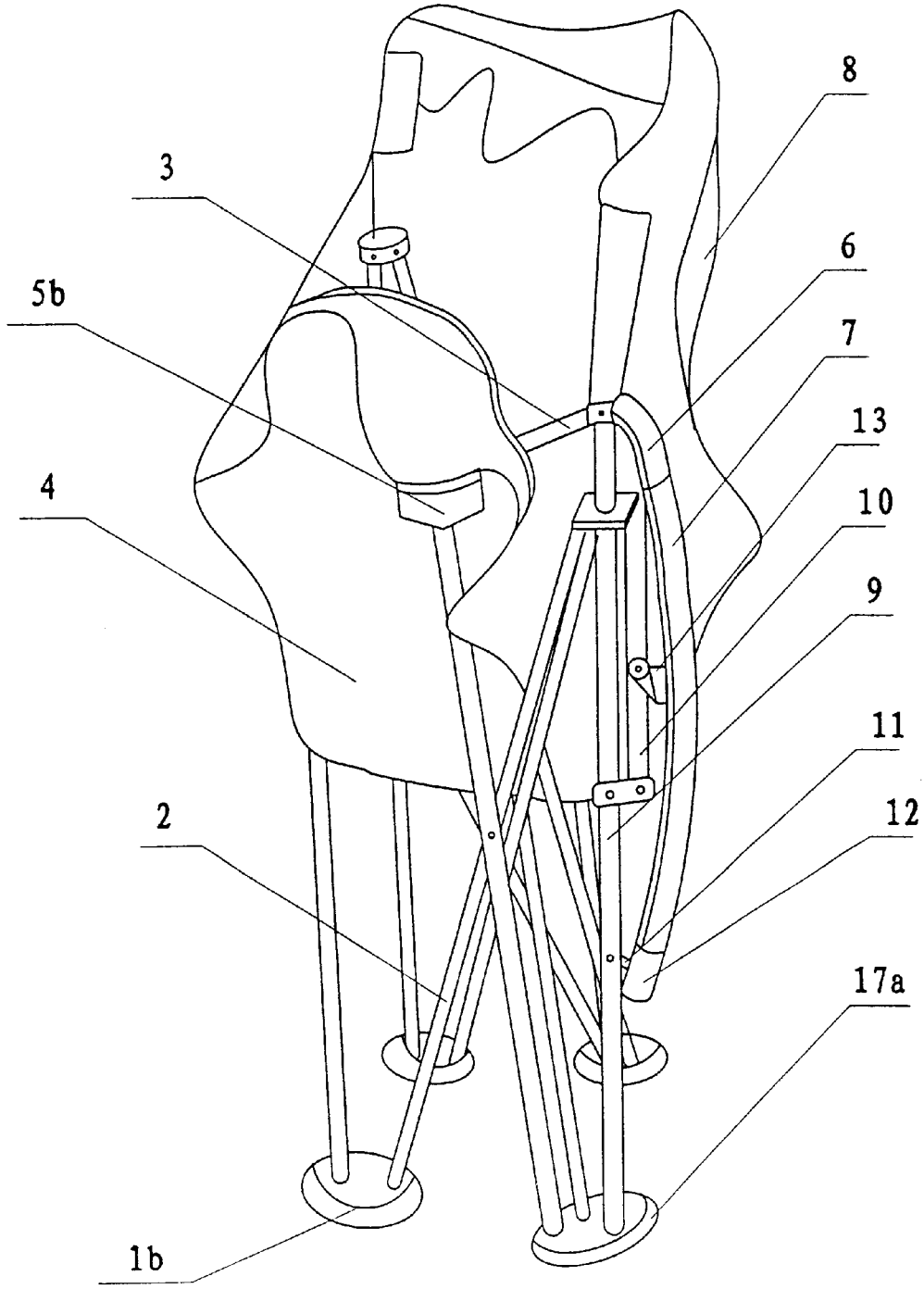
FIG. 3 is another schematic diagram of folding chair with hard arms of the invention, the folding chair in the diagram is in the withdrawal or folded state.
Figure 4:
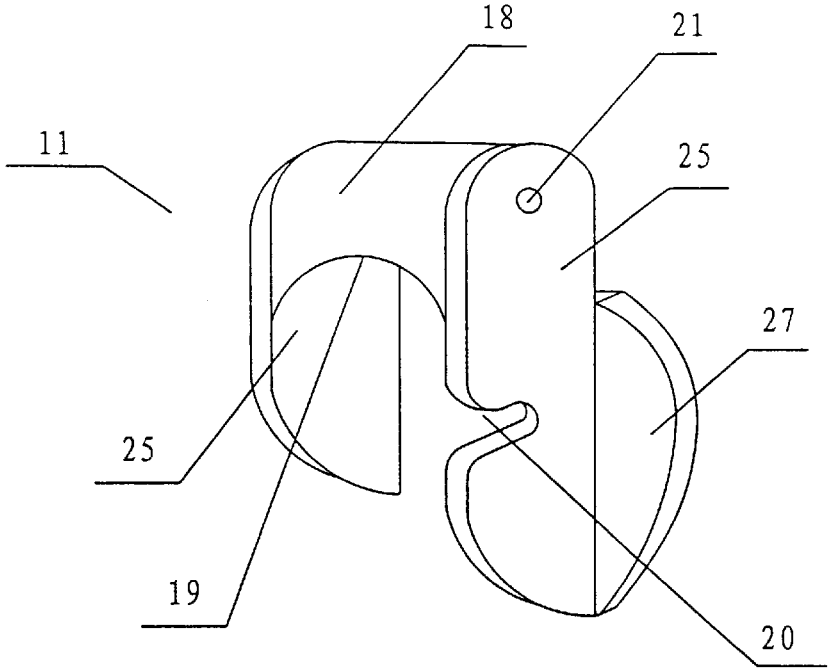
FIG. 4 is a stereo-schematic diagram of arm fixing shackle for folding chair with hard arms of the invention.
Figure 5:
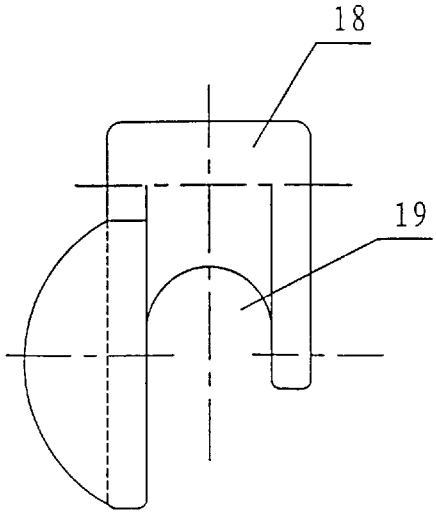
FIG. 5 is the front view of the arm fixing shackle shown in FIG. 4.
Figure 6:
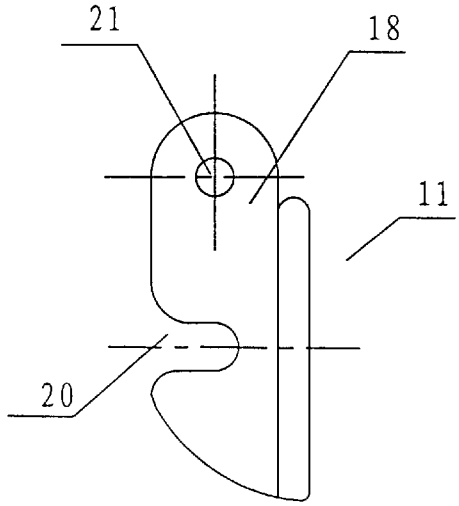
FIG. 6 is the side view of the arm fixing shackle shown in FIG. 4.
Figure 7:
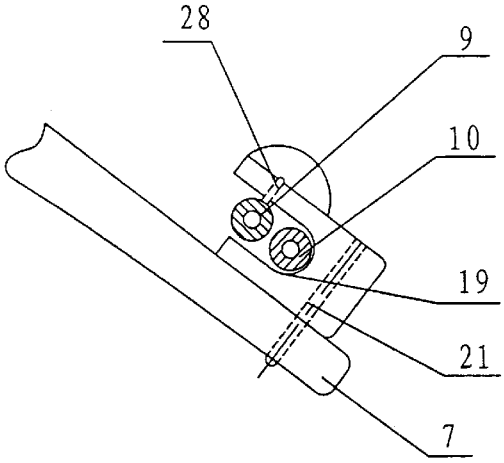
FIG. 7 is a sectional schematic diagram of folding chair along line E—E in FIG. 2.

As shown in FIGS. 2 and 3, a folding chair with hard arms of the present invention has front and rear support tubes 2, and left and right support tubes 3. The bottom ends of the support tubes are connected with leg bases 1*a*, 1*b*, 17*a* and 17*b*. The front and rear support tubes 2 are mutually hinged around the middle of the tubes. The left and right support tubes 3 are also mutually hinged around the middle of the tubes. The upper ends of the support tubes 2 and 3 are connected with seat bases 5*a*, 5*b*, 16*a* and 16*b* (not shown in diagram). Four corners of seat plane 4 are connected with the seat bases 5*a*, 5*b*, 16*a* and 16*b* respectively. The rear part of the folding chair is provided with chair back tubes 9. The bottom ends of chair back tubes 9 connected with leg bases 17*a* and 17*b* and the middle parts of chair back tubes 9 are connected with seat bases 16*a* and 16*b*. The upper ends of chair back tubes 9 are connected with back plane 8. There are chair back auxiliary tubes 10 on both sides of the chair back part of the folding chair. The front portions of the left and right support tubes 3 are bent upward to form the arm support tubes 3'. There is a pair of hard arms 7 with one end connected pivotally, for example pin-jointed, to the upper end of the arm support tube 3' and with the other end connected pivotally, for example pin-jointed, to the arm fixing shackle 11. A sliding element 13 has one end connected pivotally, for example pin-jointed, to the auxiliary tube 10 and another end slide-connected with the hard arm As shown in FIGS. 2 and 3, a folding chair with hard arms of the present invention has two front and two rear support tubes 2, and two left and two right support tubes 3. The bottom ends of the support tubes are connected with leg bases 1*a*, 1*b*, 17*a* and 17*b*. The two front support tubes and two rear support tubes 2 are mutually hinged around the middle of the tubes, respectively. The two left support tubes and two right support tubes 3 are also mutually hinged around the middle of the tubes, respectively. The upper ends of the support tubes 2 and 3 are connected with seat bases 5*a*, 5*b*, 16*a* and 16*b* (not shown in diagram). Four corners of seat plane 4 are connected with the seat bases 5*a*, 5*b*, 16*a* and 16*b* respectively. The rear part of the folding chair is provided with chair back tubes 9. The bottom ends of chair back tubes 9 connected with leg bases 17*a* and 17*b* and the middle parts of chair back tubes 9 are connected with seat bases 16*a* and 16*b*. The upper ends of chair back tubes 9 are connected with back plane 8. There are chair back auxiliary tubes 10 on both sides of the chair back part of the folding chair. The front portions of the left and right support tubes 3 are bent upward to form the arm support tubes 3'. There is a pair of hard arms 7 with one end connected pivotally, for example pin-jointed, to the upper end of the arm support tube 3' and with the other end connected pivotally, for example pin-jointed, to the arm fixing shackle 11. A sliding element 13 has one end connected pivotally, for example pin-jointed, to the auxiliary tube 10 and another end slide-connected with the hard arm 7.

FIG. 3 is a schematic diagram of folding chair in the withdrawal or folded state. In this state, the sliding element 13 slides along the hard arm 7, the rear end of the hard arm 7 also slides downward and is vertically close to the chair back tube 9.

FIGS. 4–7 show the structure and the use of the arm fixing shackle 11 of the hard arm folding chair of the present invention. The shackle 11 has a shackle body 18 which can be in a gallows frame shape. There is a connection hole 21 on the top part of the shackle body 18. The top part of the shackle body 18 extends downward to form two side arms 25. There is a bayonet 19 set between the two side arms 25 and connection hole 21. The shackle body 18 is connected pivotally with the rear end of the hard arm 7 using a pin through the connection hole 21. The bayonet 19 can lock on the auxiliary tube 10 and the chair back tube 9. The chair back tube 9 has a locating pin set close to the upper end. The side arm of the arm fixing shackle 11 has a shackle slot 20 for clamp-fixing the locating pin. The side arms can be different in length, and the shackle Is slot can be positioned on the slightly longer side arm. On one side arm of the arm fixing shackle 11 there is a positional element 27 perpendicular to the side arm.

As further shown in FIG. 2, the hard arms of the folding chair in the present invention are stably and firmly connected with support tubes of the folding chair, and a flexible material forms the seat plane 4 and the back plane 8 of the folding chair The seat plane 4 is set up on the seat bases 5*a*, 5*b*, 16*a* and 16*b* by connecting through rings 14 and button-head tubes 15 respectively. The back plane 8 can be sleeved on the chair back tubes 9. The flexible material can be oxford cloth and a polyurethane coat can be applied on the cloth. Other suitable material can also be used as the flexible material.

There is also a second locating pin at the lower part of the chair back tube 9. It is used to lock the arm fixing shackle 11 when the hard arm folding chair of the present invention is in the withdrawal state, to fix the hard arms 7 in position.

Figure 8:
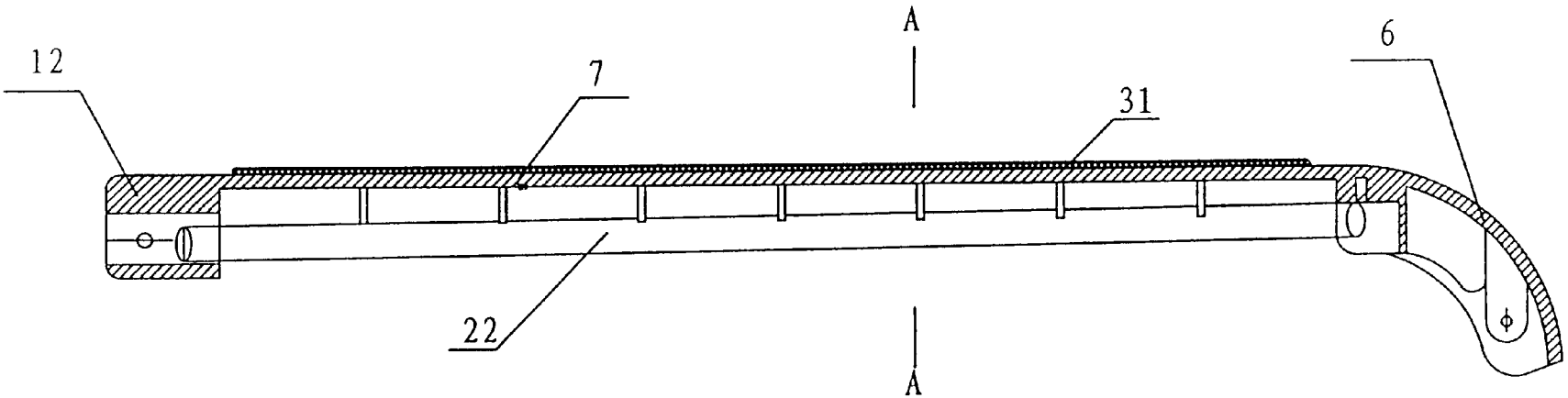
FIG. 8 is a structural schematic diagram of the first embodiment for the arm of the folding chair of the invention shown in FIG. 2.
Figure 8:
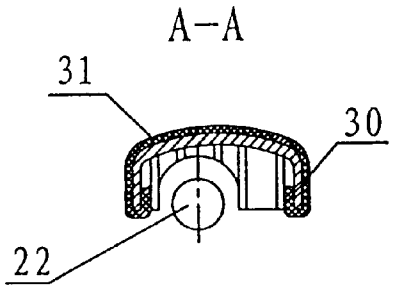

Now the first embodiment for the arms of the folding chair of the present invention is explained with reference to FIG. 8.

The front end 6 of the hard arm 7 is pivotally connected, for example pin-jointed, to the upper end of the arm support tube 3', and the rear end 12 of the hard arm 7 is pivotally connected to the connecting hole 21 of the arm fixing shackle 11. The arm fixing shackle 11 is used to lock and fix the hard arm 7. The bottom portion of the hard arm 7 has a sliding-rod 22. On inside and outside of the bottom portion of the hard arm 107 there is a groove 30 for inserting the arm covering cloth 31. The hard arm 7 can be made of plastics or other suitable materials.

Figure 9:
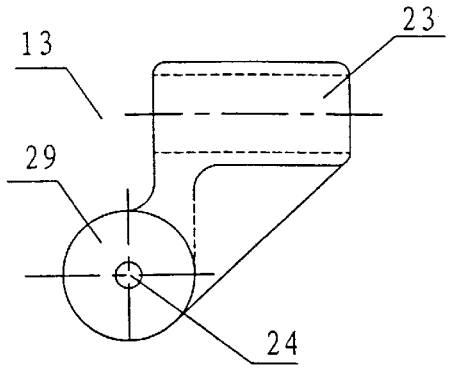
FIG. 9 is the front view of the sliding element used in the first embodiment for folding chair with hard arms of the invention shown in FIG. 8.

Also refer to FIG. 9, a sliding element 13 is mounted on the sliding-rod 22. The sliding element 13 has a sliding body, its upper portion having a sliding sleeve which has a sliding hole 23, and the lower portion having a lug 29. The lug 29 is 15 perpendicular to the axis of the sliding hole 23, and the lug 29 has a connection hole 24.

The sliding element 13 is fixed on the auxiliary tube 10 by a pin shaft through the connection hole 24 and connected pivotally to the middle part of the auxiliary tube 10. The sliding-hole 23 on the sliding element 13 operates together with the sliding-rod 22. In a process of unfolding or folding the instant folding chair, the sliding element 13 slides freely along the sliding-rod 22 at the bottom of the hard arm 7.

Figure 10:
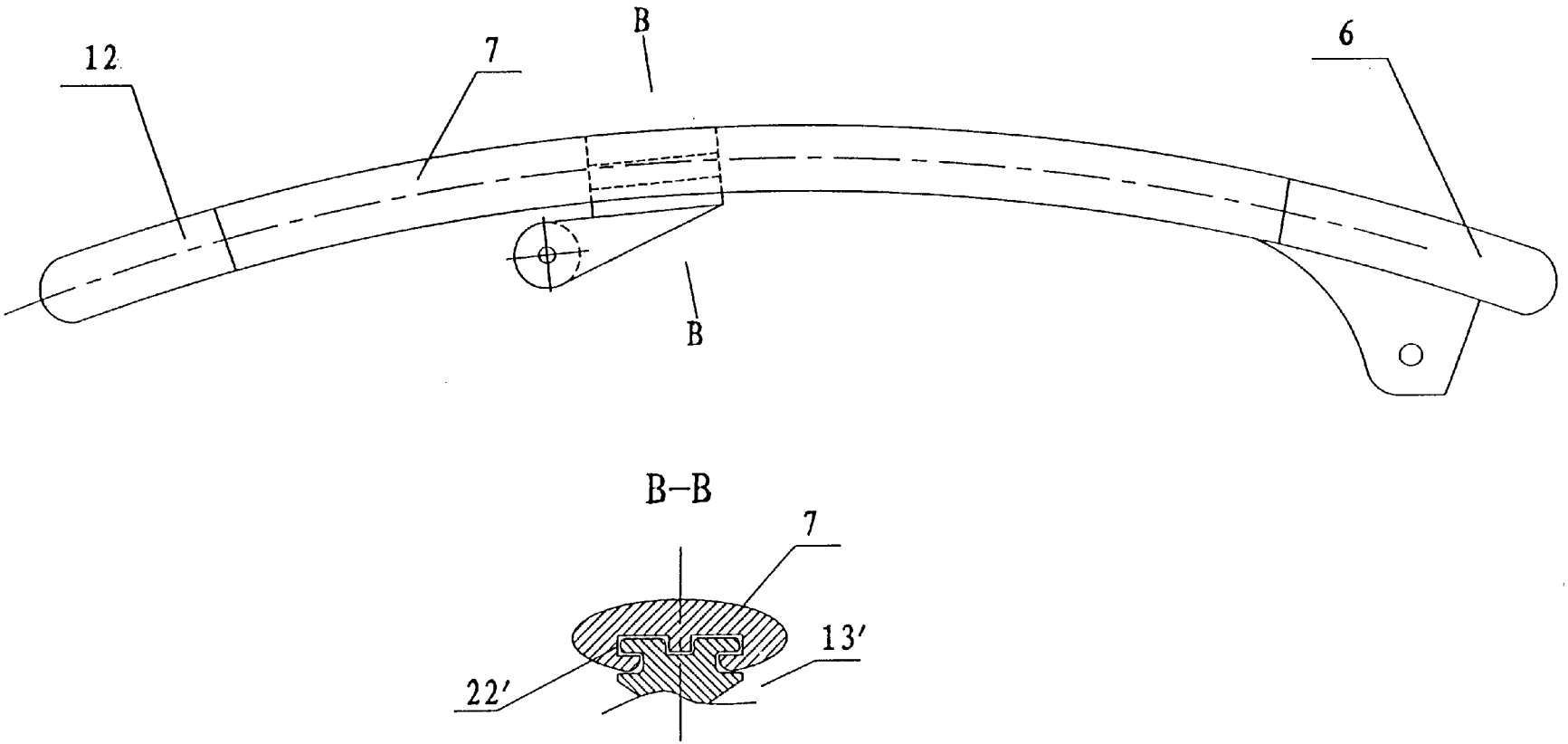
FIG. 10 is a structural schematic diagram of the second embodiment for the arm of the folding chair of the invention shown in FIG. 2.

Now the structure of the second embodiment for the folding chair arms of the present invention is explained with reference to FIG. 10.

Figure 11:
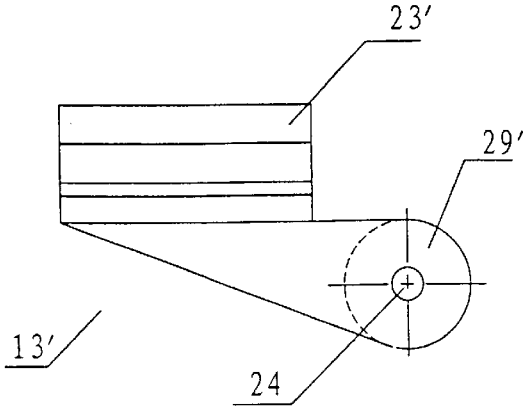
FIG. 11 is the front view of the sliding element used in the second embodiment for the arm of the folding chair of the invention in FIG. 10.
Figure 12:
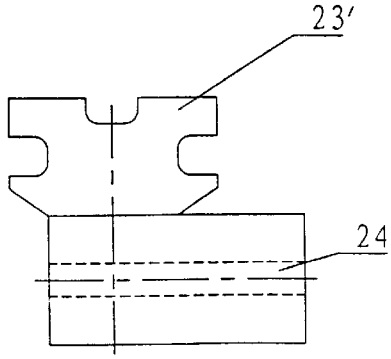
FIG. 12 is the side view of the sliding element in FIG. 10.

It can be seen from the diagram that in this embodiment the bottom portion of the hard arm 7 has a sliding groove 22'. A sliding element 13' is located in the sliding groove 22'. Further refer to FIG. 11 and 12, the sliding element 13' has a sliding convex block 23' on its top portion and a lug 29' at the lower portion. The lug 29' has a connection hole 24. In a process of unfolding or folding the instant folding chair, the sliding convex block 23' of the sliding element 13' operates together with the sliding groove 22', and the sliding element 13' slides freely along the sliding groove 22' at the bottom of the hard arms 7. The sliding element 13' is fixed on the auxiliary tube 10 by pin shaft through the connection hole 24 and pivotally connected to the middle part of the auxiliary tube 10. The structures of the front and rear ends of the hard arm 7 are the same to those of the first embodiment, and they are not repeated herein. The shape of the sliding groove 22' described above matches with the shape of the sliding convex block 23', which can in the shape as shown in FIGS. 10 and 12, and can also be in shape of dovetail. The hard arm can be made of metal or other suitable materials.

When the hard arm folding chair of the present invention is in use, the arm fixing shackle 11 is separated from a fixing pin located at the lower part of the chair back tube 9 to open the folding chair frame. The sliding convex block 23' (or sliding sleeve 23) slides to the rear end of the hard arm 7 along the sliding groove 22' (or sliding-rod 22) at the bottom of the hard arm 7. Clamp-fix the arm fixing shackle 11 located at the rear end of the hard arm 7 onto the chair back tube 9 and the chair back auxiliary tube 10, and fix the hard arms in position, then the hard arm folding chair is ready to use. When the folding chair is withdrawn or folded, first to separate the arm fixing shackle 11 from the chair back tube 9 and the chair back auxiliary tube 10, and fold the folding chair frame and the flexible material. The sliding convex block 23' (or sliding sleeve 23) slides along the sliding groove 22' (or sliding-rod 22) located at the bottom of the hard arm 7, and the rear end of the hard arm 7 slides downward and moves vertically close to the chair back tube 9. Clasp the arm fixing shackle 11 located at the rear end of the hard arm 7 tightly on the second locating pin located at the lower part of chair back tube 9, then the hard arm folding chair is folded altogether. The folded folding chair has small volume, and can be put into a folding chair packaging bag for carrying or storage.

While the present invention has been described in detail and pictorially shown in of the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

What is claimed is:

1. A folding chair with hard arms, wherein said folding chair has two front and two rear support tubes, two left and two right support tubes, bottom ends of said support tubes being connected with leg bases, and upper ends of said support tubes being connected with seat bases; said each pair of two left, two right, two front and two rear support tubes being respectively mutually hinged at middle portions thereof; a seat plane with four corners connected with said seat bases; and two chair back tubes at a rear part of said folding chair; bottom ends of said chair back tubes being connected with said leg bases, middle parts of said chair back tubes being connected with seat bases; and upper ends of said chair back tubes being connected with a back plane, characterized in that said hard arm folding chair has a chair back auxiliary tube next to each of said chair back tubes of said folding chair; two arm support tubes formed by upward bending of front portions of said left and right support tubes; a hard arm on each side of said folding chair wherein one end of said hard arm is connected pivotally to the upper end of said arm support tube, and another end is connected pivotally to an arm fixing shackle; and a sliding element on each side of said folding chair wherein one end of said sliding element is pivotally connected to said auxiliary tube and the other end is slide-connected with said hard arm.

2. The folding chair with hard arms according to claim 1, characterized in that said sliding element has a sliding body, an upper part of said sliding body having a sliding convex block, and a lower part of said sliding body having a lug, said lug having a connection hole.

3. The folding chair with hard arms according to claim 2, characterized in that a bottom of said hard arm has a sliding concave groove.

4. The folding chair with hard arms according to claim 3, characterized in that said sliding convex block of said sliding element is matched with said sliding concave groove at said bottom of said hard arm.

5. The folding chair with hard arms according to claim 2, characterized in that said lug at said lower part of said sliding element is pivotally connected to a middle part of said auxiliary tube by a pin shaft through said connection hole of said lug.

6. The folding chair with hard arms according to claim 1, characterized in that said arm fixing shackle has a top part having a connection hole therein, said top part extending downward into two side arms, a bayonet being set between said two side arms, wherein said bayonet locks on said auxiliary tube; and said arm fixing shackle has a shackle slot on one side arm of said arm fixing shackle for clamp-fixing onto a first locating pin of said chair back tube, said first locating pin positioned close to an upper end of said chair back tube.

7. The folding chair with hard arms according to claim 6, characterized in that one of said side arms of said arm fixing shackle is extended to form a positional element.

8. The folding chair with hard arms according to claim 6, characterized in that a lower part of said chair back tube further has a second locating pin.

9. The folding chair with hard arms according to claim 1, characterized in that said hard arm has a sliding-rod at a bottom of said hard arm, one end of said sliding-rod being connected with a front end of said hard arm, and another end of said sliding-rod being connected with a rear end of said hard arm.

10. The folding chair with hard arms according to claim 9, characterized in that said sliding element has a sliding body, an upper part of said sliding body having a sliding-sleeve, and a lower part of said sliding body having a lug, said lug having a connection hole.

11. The folding chair with hard arms according to claim 10, characterized i n that said sliding-sleeve of said sliding element is matched with said sliding-rod on said bottom of said hard arms.

12. The folding chair with hard arms according to claim 10, characterized in that said lug at said lower part of said sliding element is pivotally connected with a middle part of said auxiliary tube by a pin shaft through said connection hole of said lug.

13. The folding chair with hard arms according to claim 9, characterized in that said hard arm has grooves for inserting and holding arm covering cloth.

* * * * *